US008671876B2

(12) United States Patent
McGough

(10) Patent No.: US 8,671,876 B2
(45) Date of Patent: Mar. 18, 2014

(54) SYSTEM AND METHOD FOR MANAGING ENERGY USAGE IN A MANUFACTURING FACILITY

(75) Inventor: Louis F. McGough, Rockford, MI (US)

(73) Assignee: Thierica Equipment Corporation, Walker, MI (US)

( * ) Notice: Subject to any disclaimer, the term of this patent is extended or adjusted under 35 U.S.C. 154(b) by 722 days.

(21) Appl. No.: 12/718,187

(22) Filed: Mar. 5, 2010

(65) Prior Publication Data

US 2011/0217474 A1 Sep. 8, 2011

(51) Int. Cl.
*B05C 15/00* (2006.01)

(52) U.S. Cl.
USPC ..... 118/326; 118/323; 118/DIG. 7

(58) Field of Classification Search
USPC ..... 118/326, 323, DIG. 7; 454/52, 54, 55; 55/DIG. 46; 96/228
See application file for complete search history.

(56) References Cited

U.S. PATENT DOCUMENTS

| | | | | |
|---|---|---|---|---|
| 4,295,866 | A | 10/1981 | Kearny | |
| 4,367,787 | A * | 1/1983 | Bradshaw | 165/222 |
| 5,746,650 | A * | 5/1998 | Johnson et al. | 454/52 |
| 6,837,931 | B1 | 1/2005 | McGough | |
| 2002/0096319 | A1 * | 7/2002 | Valachovic | 165/263 |

* cited by examiner

*Primary Examiner* — Laura Edwards
(74) *Attorney, Agent, or Firm* — Gardner, Linn, Burkhart & Flory, LLP

(57) ABSTRACT

A system and method for managing energy usage in a manufacturing facility includes harvesting the thermal properties of paint particulate wash for pre-conditioning air that is drawn into the building. The drawn-in air may be conditioned to a target temperature by an air makeup unit and then used in a painting operation wherein the air is subsequently passed through a water wash unit. Heat exchangers in thermal communication with the water inside the wash unit enable heat to either be transferred from the water to the air makeup unit, or vice versa. One or more ovens may have their energy usage managed in such a manner that they switch between using gas heat and electrical heat. Such management may take into account the daily variation in electrical rates, as well as the total amount of electrical usage currently being drawn by the electrical utility customer.

8 Claims, 7 Drawing Sheets

SYSTEM AND METHOD FOR MANAGING ENERGY USAGE IN A MANUFACTURING FACILITY

BACKGROUND OF THE INVENTION

The present invention relates generally to managing the amount of energy consumed by a manufacturing facility, and more particularly to a system and method for reducing the energy consumption of a facility in which painting and/or paint-drying operations may take place.

In many paint application facilities, it is desirable to apply the paint to one or more particular products at a controlled temperature and/or humidity. Such control of the temperature and humidity facilitates the application of the paint to the product. Air makeup units are often used to draw air from outside the building into the building. The air makeup units change the humidity to the desired level and adjust the temperature as necessary before delivering the air to the interior of the building. The air may be specifically delivered to one or more paint spray booths where paint is applied in a spray fashion to one or more products.

As is known in the art, the paint particulates that end up in the air during the spray painting process can be removed via one or more water wash units. Such water wash units may clean the air of paint particulate by passing the air over or through one or more water curtains. Such a process causes the paint particulates in the air to be transferred to the water. The paint particulates can then be removed from the water through the use of known flocculating agents and/or other methods.

The amount of energy consumed by the air makeup unit in conditioning the air to the desired temperature and/or humidity may be significant. While such energy consumption can be mitigated by recirculating a least a portion of the conditioned air—after going through the water wash—the water washes are rarely, if ever, capable of removing 100% of the paint particulate. Therefore, the residual paint particulate in the recirculating air may accumulate in undesirable locations and/or cause clogging, or contribute to other functional degradations of the system. In order to avoid these problems, the washed air may simply be vented to the atmosphere rather than recirculated.

The manufacturing facilities that apply paint to products may also include one or more drying booths in which the painted products are heated until the paint dries. Such drying booths may alternatively be located in separate facilities. Regardless of their location, such drying booths may also consume a significant amount of power.

SUMMARY OF THE INVENTION

The present invention provides various systems and methods for decreasing the energy usage costs associated with a manufacturing facility, particularly a manufacturing facility that utilizes heated drying booths or paint spray wash units, or both. In one embodiment, the systems and methods utilize the water in the spray wash booth as either a heat source or heat sink for assisting the air makeup unit in its conditioning of the air drawn into the building. In another embodiment, systems and methods are provided for monitoring the total electricity usage of the electrical customer and making adjustments to the electrical usage, if necessary, in order to reduce the fees charged by the electrical utility.

According to one embodiment, an energy management system for a building is provided. The system includes an air intake unit, a paint spray booth, a water wash unit, and a pipe subsystem. The air intake unit draws air from outside the building into an interior of the building and is adapted to condition the air to a target temperature. The paint spray booth houses an area where paint is applied to at least one product in the presence of the conditioned air. The water wash unit includes a water basin and the water wash unit removes paint particulate from the conditioned air. The pipe subsystem circulates a liquid between the water basin and the air intake unit wherein the circulated liquid transfers heat between the water basin and the air intake unit in such a manner so as to assist the air intake unit in conditioning the air drawn from outside the building.

According to another embodiment, an energy management system is provided that includes an oven, an electric heater, a gas powered burner, a meter, and a controller. The oven is adapted to dry product positioned therein. The gas powered burner supplies heat to the oven when activated. The electrical heater also supplies heat to the oven when activated. The meter measures a total amount of electrical power currently being consumed by a plurality of electrical devices within the building, including the electric heater. The control unit communicates with the meter, the burner, and the electric heater. The control unit is adapted to automatically switch between activating the burner and the electric heater based upon whether the burner or the electric heater is currently more economical to use for heating the oven.

According to another embodiment, an energy management system is provided that includes an oven, an electric heater, a gas burner, a meter, and a control unit. The oven is adapted to dry product positioned therein. The gas-powered burner supplies heat to the oven when activated. The electric heater also supplies heat to the oven when activated. The meter measures a total amount of electrical power currently being consumed by a plurality of electrical devices within the building, including the electric heater. The control unit communicates with the meter, the burner, and the electric heater. The control unit activates the gas burner if the total electrical power consumption measured by the meter exceeds a threshold.

According to another embodiment, a method of managing energy usage for a building is provided. The method includes drawing air into an air makeup unit adapted to condition the air to a target temperature and a target humidity. The method further includes directing the conditioned air from the air makeup unit to a paint spray booth that houses an area in which paint is applied to at least one product in the presence of the conditioned air; removing paint particulate from the conditioned air by passing the conditioned air through a water wash unit having a water basin; and using a liquid to transfer heat between the water basin and the air makeup unit such that less energy is used by the air makeup unit in changing the temperature and humidity of the air drawn into the air makeup unit.

According to still another embodiment, a method of managing energy usage is provided. The method includes drawing air into an air makeup unit adapted to condition the air to a target temperature and a target humidity; directing the conditioned air from the air makeup unit to a paint spray booth in which paint is applied to at least one product; removing paint particulate from the conditioned air by passing the conditioned air through a water wash unit having a water basin; and using a liquid to transfer heat between the water basin and the air makeup unit such that less energy is used by the air makeup unit in changing the temperature and humidity of the air drawn into the air makeup unit.

According to still other embodiments, the pipe subsystem may include first and second heat exchangers where the first heat exchanger transfers heat between the water basin and the liquid in the pipe subsystem, and the second heat exchanger transfers heat between the air intake unit and the liquid inside the pipe subsystem. The pipe subsystem may transfer heat from the water basin to the air intake unit, or, conversely, the pipe subsystem may transfer heat away from the air intake unit to the water basin. The direction of heat flow may be dependent upon the outside air temperature and the target temperature for the conditioned air, and the direction of the heat flow may change automatically without any human interaction necessary. The liquid inside the pipe subsystem may include pure water, or water mixed with one or more additional liquids. A pump may be used to pump water between the water basin and the air intake unit. A temperature sensor may be positioned within the air inlet unit and a controller may control the flow rate of the pump based at least partially upon the sensed temperature. Multiple spray booths may be included wherein the pipe subsystem transfers heat between each of the water basins and the air intake unit.

In still other embodiments, the gas-powered burner may be adapted to burn natural gas. The monitoring of the total electrical power consumption may include all of the power currently being drawn by the manufacturing plant customer from a particular electrical utility. The control unit may include a memory that stores price information regarding the cost of electrical power, such as, but not limited to, the time(s) during the day, week, or month at which price changes for the electrical power take place. The control unit may further use the price data in determining whether to activate the burner or the electric heater for the oven. Multiple ovens may be controlled by the control unit such that the control unit switches on or off multiple of the burners in whatever manner is necessary in order to minimize utility charges. The control unit may activate the gas burner if the total electrical consumption exceeds a threshold, and the threshold may vary in accordance with one or more service agreements between the electrical consumer and the electric utility.

DETAILED DESCRIPTION OF THE EMBODIMENTS

Figure 1:
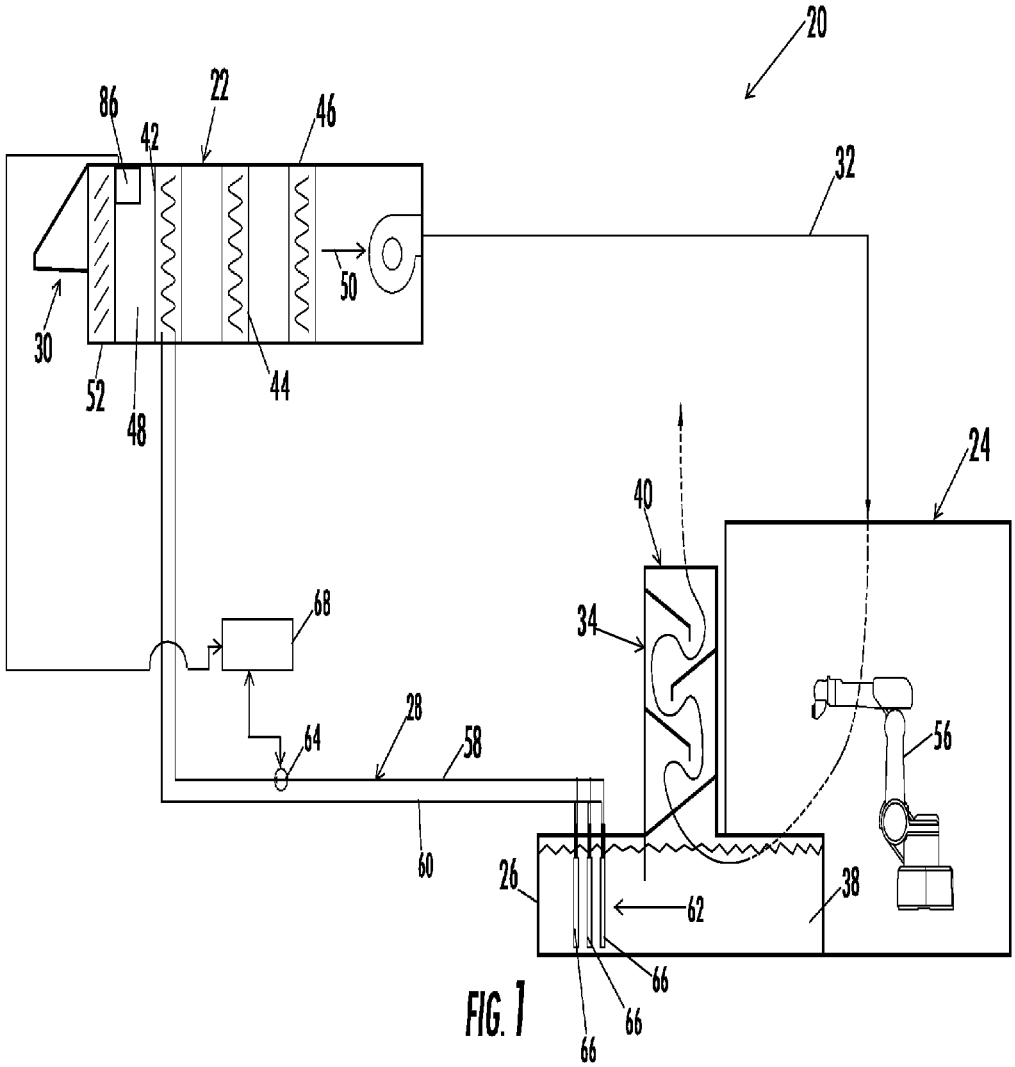
FIG. 1 is a plan view diagram of an energy management system according to a first embodiment.

A diagram of an energy management system 20 according to a first embodiment is shown in FIG. 1. System 20 includes an air makeup or air intake unit 22, one or more spray booths 24 having at least one water basin 26, and a pipe subsystem 28. Air intake unit 22 may be positioned on a roof of a building in which energy management system 20 is incorporated, or air intake unit 22 may be positioned elsewhere. Air intake unit 22 includes an inlet 30 that draws air into unit 22 from a location external to unit 22. In most situations, air intake unit 22 will draw air from outside of the building in which the unit 22 is being used, although it would be possible to utilize an air intake unit that drew air from another source. Air intake unit 22 may be a conventional and commercially available air makeup unit that is modified in the manner described herein. In general, air intake unit 22 is constructed to change, to the extent necessary, the temperature and humidity of the air drawn in through inlet 30. After conditioning the air to the desired humidity level and temperature, air intake unit 22 delivers the conditioned air to an air conduit 32 that transports the conditioned air to one or more spray booths 24.

Spray booths 24 may be constructed in any suitable manner. Spray booths 24 provide an area where spray paint may be applied to whatever products are being processed within the facility. In some embodiments, spray booths 24 may be configured to apply paint to one or more automotive components. In other embodiments, spray booths 24 may be configured to apply paint to other types of manufactured products. Indeed, the type of product to which paint is applied in spray booths 24 is not limited by energy management system 20.

The conditioned air that is output from air intake unit 22 will generally have a temperature that is within a few of degrees of a target temperature, as well as a relative humidity that is within a few percentage points of a desired humidity. The precise numbers for the target temperature and humidity may vary depending upon the type of paint being applied, as well as the product to which the paint is being applied, and/or other factors. Regardless of the specific target temperature and humidity, air makeup unit 22 serves to condition the air to a temperature and humidity level that are conducive to the painting, or other type of manufacturing operation, that is taking place within the facility. In at least one embodiment, the target temperature may be in the range of 72 to 76 degrees Fahrenheit, while the target humidity may be in the range of about 55% relative humidity. It will be understood by those skilled in the art that both the target temperature and target humidity may vary from these levels, and that the energy management systems disclosed herein are not limited to any particular target temperature or target humidity.

A water wash booth or unit 34 is associated with one or more spray booths 24. Water wash booth 34 is adapted to remove the paint particulate that accumulates in the air of spray booths 24 from the painting operation. Water wash booth 34 may be any conventional or unconventional structure that utilizes a liquid to remove the paint particulate from the air inside of one or more spray booths 24. As but one example, water wash booth 34 may be constructed in accordance the water wash booths disclosed in commonly assigned U.S. Pat. No. 6,837,931 entitled Fluid Washer for a Spray Booth, the complete disclosure of which is hereby incorporated herein by reference.

Water wash unit 34 is designed to remove paint particulate from the air inside of one or more spray booths 24 by passing the air through one or more water curtains whereby most of the paint particulate in the air is transferred to the water. In the illustrated embodiment, the water 38 used by water wash units 34 is stored in one or more water basins 36. It will be understood by those skilled in the art that the water 38 stored in basins 36 and used by wash units 34 may have chemicals and/or other liquids added to it that make it more suitable for use in wash units 34. Water 38 therefore may not be purely and solely water, but instead may include additional ingredients. The paint particulates that accumulate in water 38 may be removed therefrom through known methods, such as, but not limited to, the use of flocculating agents that cluster the particulate matter in the water.

After the particulate-laden air from inside spray booths 24 has passed through water wash unit 34 and most of the particulate matter is removed therefrom, the washed air is typically vented out of an outlet 40 to the atmosphere. Typically, outlet 40 will be positioned such that the washed air is released into the atmosphere outside of the building, or other facility, into which energy management system 20 is incorporated. While it would be possible to attempt to re-use some of the washed air by diverting it back into the spray booths 24, such recycling of the washed air can be undesirable because the washing process does not completely eliminate all of the paint particulate matter. As a result, the residual paint particulate that is not washed out of the air would tend to accumulate to greater levels as more and more washed air is recycled, and such accumulation might clog filters and/or other structures. Accordingly, for at least these reasons, the washed air is often vented to the outside of the building and not recycled. By not recycling the air, fresh air must be drawn into the building through intake unit 22 and conditioned to the right temperature and humidity. This conditioning of more fresh air obviously requires more energy.

At least one embodiment of energy management system 20 is adapted to reduce the amount of energy used by air intake unit 22 in conditioning the fresh air drawn into the building by unit 22. This energy reduction is accomplished without the use of any air recycling. That is, the air that is washed in water wash units 34 is still vented to atmosphere after substantially all of the paint particulate is scrubbed therefrom. In general, and as will be explained in greater detail below, energy management system 20 reduces the energy consumption of air intake unit 22 by utilizing one or more water basins 36 as either a heat source or a heat sink. Thus, if the air outside the building is below the desired temperature and needs to be heated, the heat energy of the water 38 inside of basin 36 is transferred to a heat exchanger inside of intake unit 22. This reduces the burden on the conventional heating coils of air intake unit 22. Conversely, if the air outside the building is higher than the desired temperature, a liquid cooled by water 38 is pumped inside of air intake units 22 in order to absorb some of the heat, and thereby reduce the burden on the conventional cooling coils inside air intake unit 22. The heat-emitting or heat-absorbing abilities of water 38—which depend upon the outside air temperature relative to the target temperature—are therefore utilized in order to pre-condition the air being drawn into unit 22. Such preconditioning lightens the energy usage of air intake unit 22.

As can be seen in FIG. 1, air intake unit 22 includes an energy recovery coil 42, a cooling coil 44, and a heating coil 46. All three of these coils are positioned in an interior 48 of intake unit 22. Intake unit 22 includes suitable fans, or other structures, that draw air into interior 48 through inlet 30. The air is that is drawn thereinto moves through interior 48 in the direction indicated by arrow 50. The air thus first passes through a filter 52 before proceeding through energy recovery coil 42, then cooling coil 44, and finally heating coil 46. Filter 52, cooling coil 44, and heating coil 46 may all be conventional components of a commercially available air makeup unit, or they may be designed or configured in nonconventional manners. If a conventional air makeup unit is used with energy management system 20, it can be modified to carry out the energy recovery principles discussed herein by adding energy recovery coil 42 and placing it in thermal communication with water basins 36, as will be discussed in greater detail below.

The physical structure and layout of each of coils 42, 44, and 46 may take on known designs. In general, each coil is arranged such that the air passing through the coil must come into physical contact with the coil and thereby have its temperature adjusted toward the target temperature. Cooling coil 44 and heating coil 46 may be powered by any conventional energy source, such as electricity, natural gas, or the like. The use of cooling coil 44 and/or heating coil 46 thus costs the operator of the facility money because the operator must pay for the electricity, natural gas, or whatever other energy source is being used. Energy recovery coil 42, in contrast, provides its heating and/or cooling abilities without the consumption of electricity (other than one or more pumps, as will be explained below). That is, energy recovery coil 42 is adapted to circulate a liquid that is housed within pipe subsystem 28. One end of the pipe subsystem 28 is in thermal communication with the water basins 36, while the other end, as noted, is in communication with energy recovery coil 42. Energy recovery coil 42 therefore performs its pre-heating or pre-cooling of the air drawn into unit 22 by the pumping of liquid through pipe subsystem 28, rather than by burning gas, using electric heaters or coolers, or the like.

Further details of energy management system 20 will now be described. After exiting from air intake unit 22, the conditioned air travels in conduit 32 to one or more spray booths 24. Conduit 32 may include multiple individual conduits and/or other air channels through which the conditioned air exiting air intake unit 22 may travel. Conduit 32 may take on a variety of different sizes, depending upon the air needs of the particular facility. In one embodiment, conduit 32 may be large enough to accommodate an air flow of approximately 10,000 cubic feet per minute, although other flow rates and/or sizes may be used. In some embodiments, there also may be multiple air intake units 22 that may merge their conditioned air into a single conduit system, or, in the alternative, utilize separate conduits. Regardless of the number of intake units 22 or the precise structure of conduit 32, the conditioned air is delivered to the inside of the spray booths 24 where one or more manufacturing operations—such as, but not limited to, painting—that desirably take place in the presence of conditioned air take place. Such painting may be carried out with the use of one or more pieces of robotic machinery 56, or by other means.

The conditioned air inside of conduit 32 is conditioned to a temperature and/or humidity that is at, or is within a small range, of the target temperature and/or target humidity. The degree of variance from the target temperature and/or target humidity, as well as the desired range of the target temperature and/or humidity, may depend upon the painting operation that is taking place, as well as the settings or capabilities of air intake unit 22. For example, some painting operations may provide acceptable results over a range of temperatures and/or humidities, and air intake unit 22 may be controlled to generate any temperature and/or any humidity that falls within the acceptable range. As another example, the capabilities of air intake unit 22 may such that it is only able to deliver conditioned air within a certain tolerance of the target temperature and/or humidity. Regardless of the range, tolerance, or other factors, air intake unit 22 delivers conditioned air to one or more spray booths 24.

As was noted above, each spray booth 24 is connected to a water wash unit 34, which functions to remove paint particulate matter from the air inside spray booths 24. After this air is cleaned of its paint particulates, it is vented to the outside of the building through outlet 40. During the paint particulate removal process, the conditioned air inside of the spray booth 24 is blown onto one or more water curtains inside of the wash units 34. These water curtains are formed from water 38, which is stored in water basins 36. Each water basin 36 may store hundreds, if not thousands, of gallons of water 38. Water 38 circulates out of basins 36 through the internal piping of wash units 34 and through the structures that create the water curtains. The water curtains spray the water downward and, in concert with gravity, return the water 38 to the basins 36. As was noted earlier, the paint particulates that accumulate in the water 38 may, either continuously or at selected times, be filtered or treated in order to remove the paint particulates therefrom.

Regardless of the manner in which the paint particulates are removed from water 38, the passing of the dirty (i.e. laden with paint particulates) conditioned air from spray booths 24 over the water curtains tends to bring the temperature of water 38 toward that of the conditioned air. Typically, the temperature of water 38 will migrate toward a temperature that is a couple of degrees less than that of the conditioned air. The lesser temperature of water 38 versus that of the conditioned air is due primarily to the heat loss associated with the evaporation of some of water 38 during the air-washing process. As a result, the temperature of the water 38 within water basins 36 will tend to move toward a temperature that is within a few degrees of the target temperature that air intake unit 22 is trying to generate for the air it processes. Water basins 36 therefore provide a heat source or heat sink for pre-conditioning the air that enters intake unit 22, as discussed in greater detail below.

Pipe subsystem 28 houses a fluid inside of it that is physically separated both from water 38 in basins 36, as well as the air inside air intake unit 22. The particular composition of the fluid housed within pipe subsystem 28 may vary, but generally may include a significant amount of water, due to its heat-capacity characteristics. Pipe subsystem 28 includes a delivery pipe 58 and a return pipe 60. Delivery pipe 58 transports the liquid inside subsystem 28 from one of more heat exchangers 62 positioned within water basins 36 to air intake unit 22, while return pipe 60 transports the liquid from air intake unit 22 back to heat exchangers 62 of water basins 36. The liquid inside pipe subsystem 28 thus circulates between heat exchangers 62 of water basins 36 and energy recovery coil 42 of air intake unit 22. One or more pumps 64 may be incorporated into pipe subsystem 28 in order to pump the liquid therein. Pump 64 may be controlled manually by a person or it may be controlled electronically by one or more electronic controllers.

Heat exchanger 62 may take on any suitable configuration for exchanging heat between the liquid inside pipe subsystem 28 and water 38 inside water basins 36. That is, heat exchanger 62 may be any suitable liquid-to-liquid heat exchanger. In the embodiment illustrated in FIG. 1, heat exchanger 62 includes a plurality of plates 66 that are positioned inside of basin 36 and in physical contact with water 38. The relatively large surface area of the plates, as well as their thermal conductivity, allows heat to be effectively exchanged between the plates and water 38. Plates 66 may be designed such that the fluid of pipe subsystem circulates directly inside the plates 66, or the plates 66 may be designed such that the fluid inside pipe subsystem does not circulate inside plates 66, but instead comes into contact with material that is in good thermal communication with plates 66. Regardless of the specific design, plates 66 may be made of metal, such as steel or other material, that conducts heat relatively well, thereby transferring heat from the warmer of water 38 and the liquid inside pipe subsystem 28 to the cooler of the two. Each water basin 36 may include one or more motors (not shown), or other structures, that cause water 38 within basins 36 to circulate, thereby ensuring that a substantially continuous flow of water 38 flows past plates 66. Plates 66 act as a liquid-to-liquid heat exchanger whereby the warmer of water 38 and the liquid in pipe subsystem 28 delivers heat to the cooler of the two liquids.

In the embodiment just described, the liquid inside of pipe subsystem 28 is physically separated from water 38. That is, the metal of plates 66 stands as a barrier between the two liquids such that the liquids do not ever touch or mix with each other. In an alternative embodiment, water 38 could be drawn into pipe subsystem from basins 36 and pumped to air intake unit 22.

Regardless of whether the liquid inside pipe subsystem 28 remains physically separate from water 38 or not, pipe subsystem 28 includes sufficient pumps 64 to enable circulation through delivery pipe 58 and return pipe 60. In at least one embodiment, one or more pumps 64 may be manually operated such that once they are turned on, they continue to pump liquid at whatever rate they are currently set to deliver, unless changes are manually made to the pumps. In this embodiment, the flow rate of the liquid inside pipe subsystem 28 does not automatically depend upon the outside air temperature, nor the difference between the outside air temperature and the target air temperature, nor the difference between the outside air temperature and the temperature of the liquid in either of delivery pipe 58 or return pipe 60.

In alternative embodiments, one or more pumps 64 could be controlled by an automatic controller 68 that adjusts the flow rate of the fluid flow in pipe subsystem 28 based at least partially upon the outside air temperature. For example, such an automatic control system could increase the flow rate of the fluid through pipe subsystem 28 the greater the difference between the outside air temperature and the target temperature for the conditioned air. Such an increased flow rate might help better assist in the preconditioning of the air as it passes through energy recovery coil 42. Alternatively, such an automatic control system might base the flow rate within pipe subsystem 28 upon a difference in temperature between the fluid in return pipe 60 and delivery pipe 58. In such a case, generally speaking, the lesser the difference in temperature between the two pipes, the more the control system might slow down the flow rate of the liquid, and vice versa (i.e. the greater the temperature difference, the more the control system might increase the flow rate). Regardless of the specific temperatures that might be monitored by such an automatic control system, one or more temperature sensing devices may be in communication with the control system such that the control system can appropriately adjust the flow rates within pipe subsystem 28. Such adjustments may be made automatically in order to reduce the amount of power that is expended in circulating the liquid of subsystem 28 such that the liquid is pumped at an optimal, or near optimal rate, for assisting in the conditioning of air drawn into intake unit 22.

The general operation of energy recovery system 20 may better be understood with reference to the following illustrative example, which it will be understood is offered merely for purposes of explanation, and not to be construed as limiting. Suppose, for example, that the target temperature for the conditioned air is seventy-five degrees Fahrenheit and that a common outside winter temperature is ten degrees, and that a common outside summer temperature is eighty-five degrees. In such a case, the liquid inside pipe subsystem 24 may, through the action of water wash unit 34, be warmed to a temperature of about seventy degrees. The liquid entering energy recovery coil 42 would therefore be about seventy degrees, and the temperature of the liquid after having passed through coil 42 and into return pipe 60 might be about fifty degrees. The difference in temperature between the liquid in pipes 58 and 60 represents the amount of heat delivered from the liquid to the air passing through energy recovery coil 42. That is, as the ten degree outside winter air passes through energy recovery coil 42, it is warmed by the liquid delivered thereto in delivery pipe 58, and the liquid is cooled by the ten degree air. The warming effect on the indrawn air thus reduces the heat energy that needs to be expended by heating coil 46 in bringing the in-drawn air up to the target temperature. After the cooled liquid in energy recovery coil 42 is returned to recovery plates 66 via return pipe 60, the liquid is re-warmed by the plates' contact with water 38. Water 38, as was noted above, is continuously warmed to about seventy degrees through the action of the conditioned air blowing on it in water wash unit 34.

As another illustrative example, consider the operation of the same energy management system 20 during the summer months. In the summer, the temperature of water 38 may be a couple of degrees higher than in the winter. Nevertheless, the effect of the conditioned air blowing on water 38 in wash units 34 would tend to keep the water 38 at around seventy-two degrees or so. After passing through plates 66, the liquid inside of delivery pipe 58 that is delivered to energy recovery coil 42 might be about seventy-two degrees as well. Therefore, the warm air drawn in from outside, which might be eighty-five degrees, will be cooled as it passes through energy recovery coil 42, thereby reducing the amount of energy expended by cooling coil 44 in bringing the indrawn air to its target temperature and/or humidity. The liquid in return pipe 60 will be warmed by the outside air, such as to eighty degrees or so. However, this warm liquid will be cooled back to about seventy-two degrees or so as it passes through plates 66. After cooling, it will be recirculated back to energy recovery coil 42 where it will continue to assist in the cooling of the indrawn warm outside air. In the examples just described, the temperature of the air that is vented to the atmosphere through outlet 40 might be about forty-five degrees in the winter and seventy-five degrees in the summer. It will, however, be understood that all of the foregoing temperatures are provided herein merely for purposes of illustration, and that such temperatures will vary depending upon the design of energy recovery system 20 and its components, as well as the outside air conditions and the target conditions.

From the foregoing examples, it should be clear that energy management system 20 helps reduces the energy expended by cooling coil 44 and/or heating coil 46 by pre-conditioning the air—via energy recovery coil 42—that is drawn into air intake unit 22. This pre-conditioning either pre-warms or pre-cools the air prior to it passing through cooling and heating coils 44 and 46. Such pre-warming or pre-cooling reduces the difference between the target air temperature and the actual air temperature, thereby requiring less cooling or heating action out of cooling coil 44 and/or heating coil 46. Substantial financial savings may thereby be reaped through lower utility costs.

Figure 2:
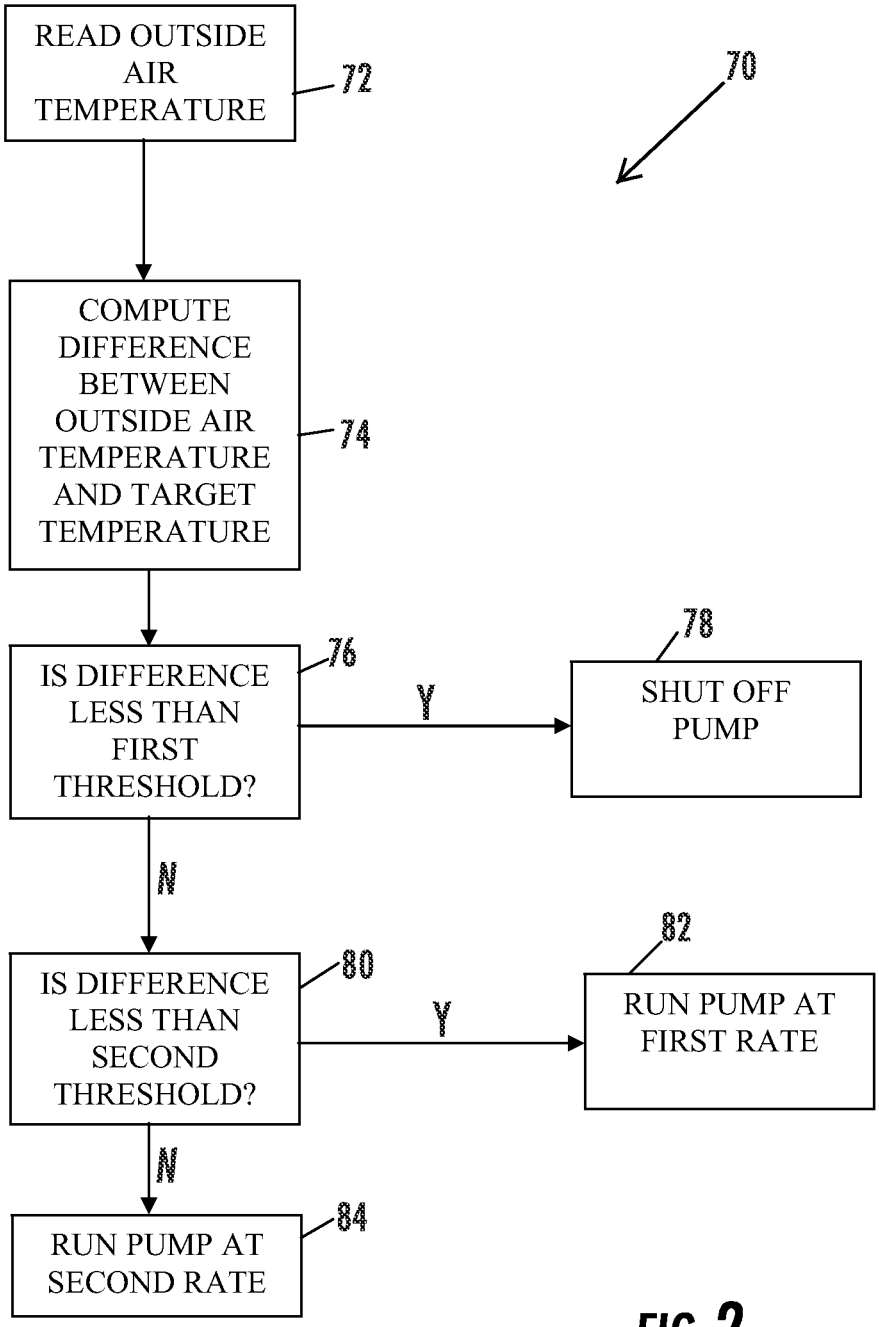
FIG. 2 is flow chart of an algorithm that may be followed by a pump controller that may be incorporated into the system of FIG. 1.

As was noted previously, one or more pumps 64 may be incorporated into pipe subsystem 28 in order to circulate the liquid contained therein between energy recovery coil 42 and plates 66. The control of pumps 64 may be as simple as a manual on-off switch that is turned on or off by a human operator, or it may be carried out automatically by a computer or other electronic device that acts as an automatic controller 68. FIG. 2 illustrates one potential control method 70 that may be followed by the computer, or other automatic control, that controls the operation of pump 64. At a first step 72, controller 68 reads from an appropriately positioned thermometer 86 the temperature of the air outside of the facility in which energy management system 20 is implemented. Any known communication method may be used for communicating such information electronically to controller 68. At a subsequent step 74, controller 68 computes the difference between the outside air temperature and the target temperature for the conditioned air that is to be delivered to one or more spray booths 24. At step 76, controller 68 compares this difference to a first threshold. If the difference is less than the first threshold, which is set to be a small amount, then controller 68 proceeds to step 78 and shuts off pump 64. In such a case, the difference between the target temperature and outside air temperature is so small that little, if any, benefit would be obtained from pumping liquid through pipe subsystem 28 and energy recovery coil 42.

If the difference is not smaller than the first threshold, then controller 68 proceeds to step 80 where it compares the outside air temperature to a second threshold that is larger than the first threshold. If the difference is smaller than the second threshold, then controller 68 may proceed to step 82 where it sends appropriate control signals to activate pump 64 to operate at a first flow rate. If the difference is greater than the second threshold, then controller 68 may proceed to step 84 where it sends appropriate control signals to activate pump 64 to operate at a second flow rate that is greater than the first flow rate. Additional thresholds and flow rates may also be added to method 70 such that the greater the temperature difference, the greater the flow rate of fluid in pipe subsystem 28. Alternatively, instead of threshold values, control method 70 could utilize a continuous change of flow rates based upon the temperature difference. Still further, as was noted previously, control method 70 could be based upon other temperature readings, other differences, and/or other factors.

Figure 3:
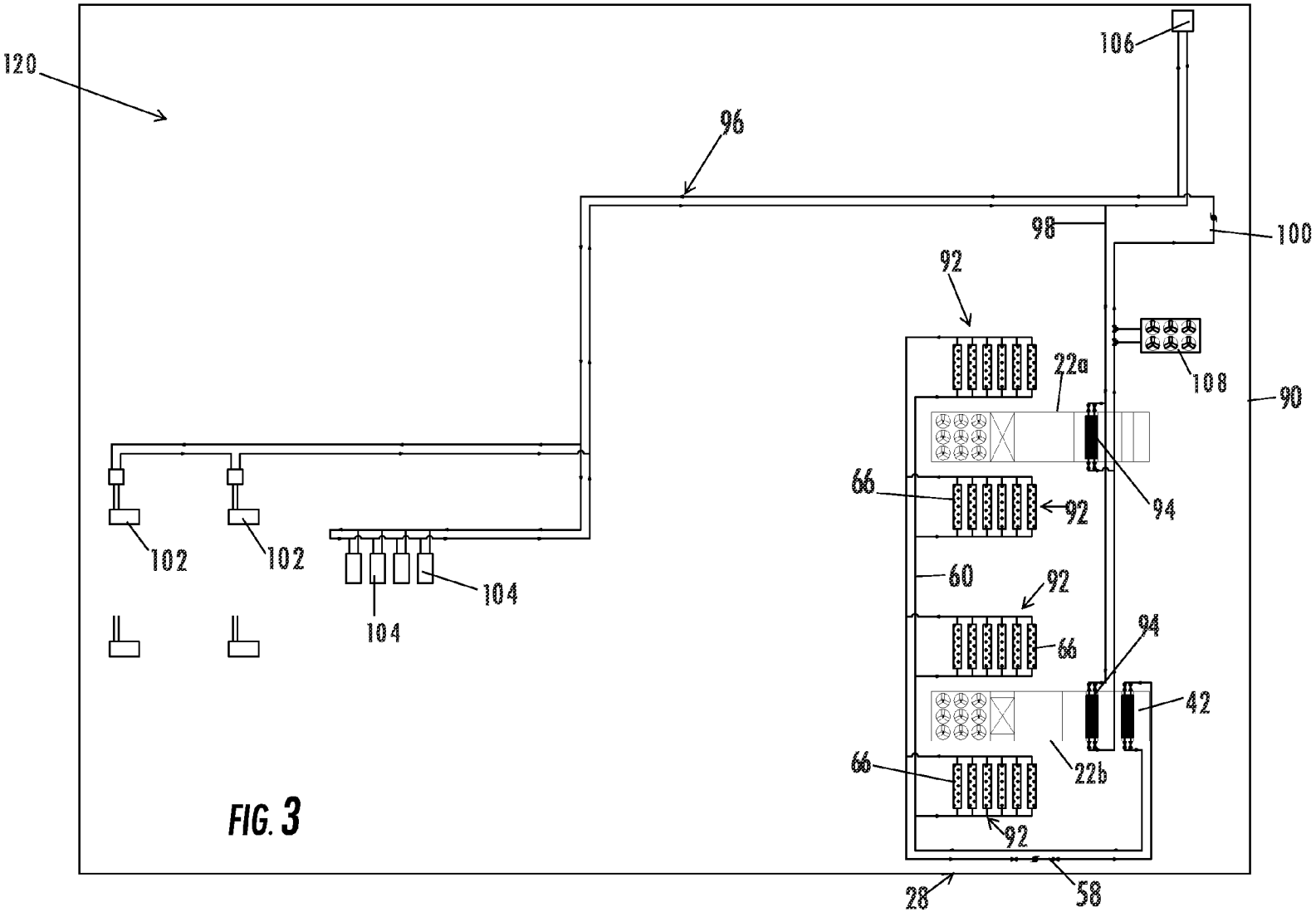
FIG. 3 is a plan view layout of an illustrative manufacturing facility that incorporates an energy management system according to another embodiment.

FIG. 3 illustrates another embodiment of an energy management system 120. Energy management system 120 includes a number of components that are common to energy management system 20 and which will therefore be identified by common reference numerals. Because such common components have already been described above with respect to energy management system 20, they will not be described further below.

Energy management system 120 of FIG. 3 is shown positioned inside a building 90. Building 90 may be a manufacturing facility or other type of building. The size, shape, and layout of building 90 as it appears in FIG. 3 is arbitrary, and it will be understood that the principles of energy management system 120 can be applied to buildings and structures of different size, shapes, and layouts. In the embodiment shown in FIG. 3, energy management system 120 includes a pair of air intake units 22*a* and 22*b*. Each air intake unit operates to draw air into building 90 and condition it to a desired temperature and/or humidity, as was described above with respect to energy management system 20. Air intake unit 22*b* includes an energy recovery coil 42 that is in fluid communication with a pipe subsystem 28. Pipe subsystem 28 includes a delivery pipe 58 and a return pipe 60 that circulate a liquid between air intake unit 22*b* and a plurality of plate sets 92. Each plate set 92 is comprised of a plurality of plates 66 that are positioned inside of a water basin 36 associated with one or more spray booths 24. A pump, not shown, circulates liquid inside of pipe subsystem 28 in the manner described above with respect to energy management system 20 such that the circulating liquid assists air intake unit 22*b* in preconditioning the in-drawn air via energy recovery coil 42. While air intake unit 22*a* in FIG. 3 is not shown with an energy recovery coil 42 in fluid communication with pipe subsystem 28, pipe subsystem 28 could be modified to include an additional energy recovery coil 42 inside of air intake unit 22*a* and in fluid communication with pipe subsystem 28.

Energy management system 120 differs from energy management system 20 primarily in that it includes an additional energy recovery coil positioned inside of the air intake units 22. More specifically, in the configuration of FIG. 3, air intake unit 22*a* includes an additional energy recovery coil 94*a* and air intake unit 22*b* includes an additional energy recovery coil 94*b*. Each additional energy recovery coil 94 may be constructed in a similar, if not identical, fashion as energy recovery coil 42. That is, each additional energy recovery coil 94 may be constructed such that outside air being drawn into air intake units 22*a* and 22*b* is forced to come into physical contact with coils 94 such that the temperature of the air is affected by the temperature of the coils 94. Stated alternatively, each coil 94 is configured to be a liquid/air heat exchanger.

Additional energy recovery coils 94*a* and 94*b* are positioned inside of air intake units 22*a* and 22*b* in a position that is upstream of the heating coils 46 and cooling coils 44 (not shown in FIG. 3). Additional energy recovery coils 94*a* and 94*b* are also each in fluid communication with an additional pipe subsystem 96. Additional pipe subsystem 96 includes a delivery pipe 98 and a return pipe 100. Additional pipe subsystem 96 differs from pipe subsystem 28 in that, instead of being in thermal communication with one or more water basins 36 via plates 66, pipe subsystem 96 is in thermal communication with other sources of heat or cooling within the building 90. For example, the layout of FIG. 3 shows additional pipe subsystem 96 in thermal communication with a pair of lasers 102 that may be utilized for manufacturing purposes within building 90, such as, but not limited to, the welding of parts. The liquid inside of additional pipe subsystem 96 absorbs the heat from the lasers 102 and serves to maintain the lasers at a sufficiently cool temperature for proper operation. As a result, lasers 102 tend to heat the liquid inside pipe subsystem 96. Pipe subsystem 96 may then transfer the heat to additional energy recovery coils 94 where the heat is used to warm the cooler outside air being drawn into air intake units 22*a* and 22*b*. Thus, additional pipe subsystem 96 tends to recycle the excess heat from the lasers 102 such that it may be used to pre-warm the air being drawn into air intakes 22*a* and 22*b*.

The components that may contribute heat to the liquid inside pipe subsystem 96 are not limited to lasers. Either in addition to lasers 102, or in lieu thereof, other structures and devices within building 90 may be in thermal communication with the liquid inside additional pipe subsystem 96. Such other structures and devices may include, for example, one or more water cooled compressors 104 wherein the water used to cool the compressors 104 is either the same as the liquid inside additional pipe subsystem 96, or is in thermal communication with the liquid inside additional pipe subsystem 96.

The circulation of the liquid inside pipe subsystem 96 between the heat-generating components, such as lasers 102, and the energy recovery coils 94 may be sufficient to cool the liquid such that the heat generating components are sufficiently cooled. However, in some situations where the passage of the liquid through energy recovery coils 94 does not sufficiently cool the liquid, other cooling structures may be in thermal communication with pipe subsystem 96. Such other structures may include a water cooled chiller 106 or an air cooled fluid cooler 108. Additionally, depending upon the length and configuration of the various pipes in pipe subsystem 96, a substantial amount of cooling of the liquid contained therein may take place as a natural result of the liquid traveling the length of the various pipes. Such cooling may be sufficient for using the liquid to cool one or more lasers 102, or other heat generating structures, without the use of either water cooled chiller 106 or air cooled fluid cooler 108.

While FIG. 3 illustrates an energy management system 120 in which thermal energy from water basins 36 and heat generating devices—such as lasers 102 and compressors 104—are both used for pre-conditioning air drawn into one or more air intake units 22, it will be understood by those skilled in the art that energy management system 120 could be modified such that only a single one of these structures (the water basins 36 or the heat generating devices) were present. Thus, for example, system 120 could be modified such that only pipe subsystem 96 and the components in thermal communication therewith were present, while pipe subsystem 28 and the components in thermal communication therewith were omitted. Conversely, system 120 could be modified to only include pipe subsystem 28 and its components while omitting pipe subsystem 96 and its components. Other variations of energy management system 120 are also possible.

Figure 4:
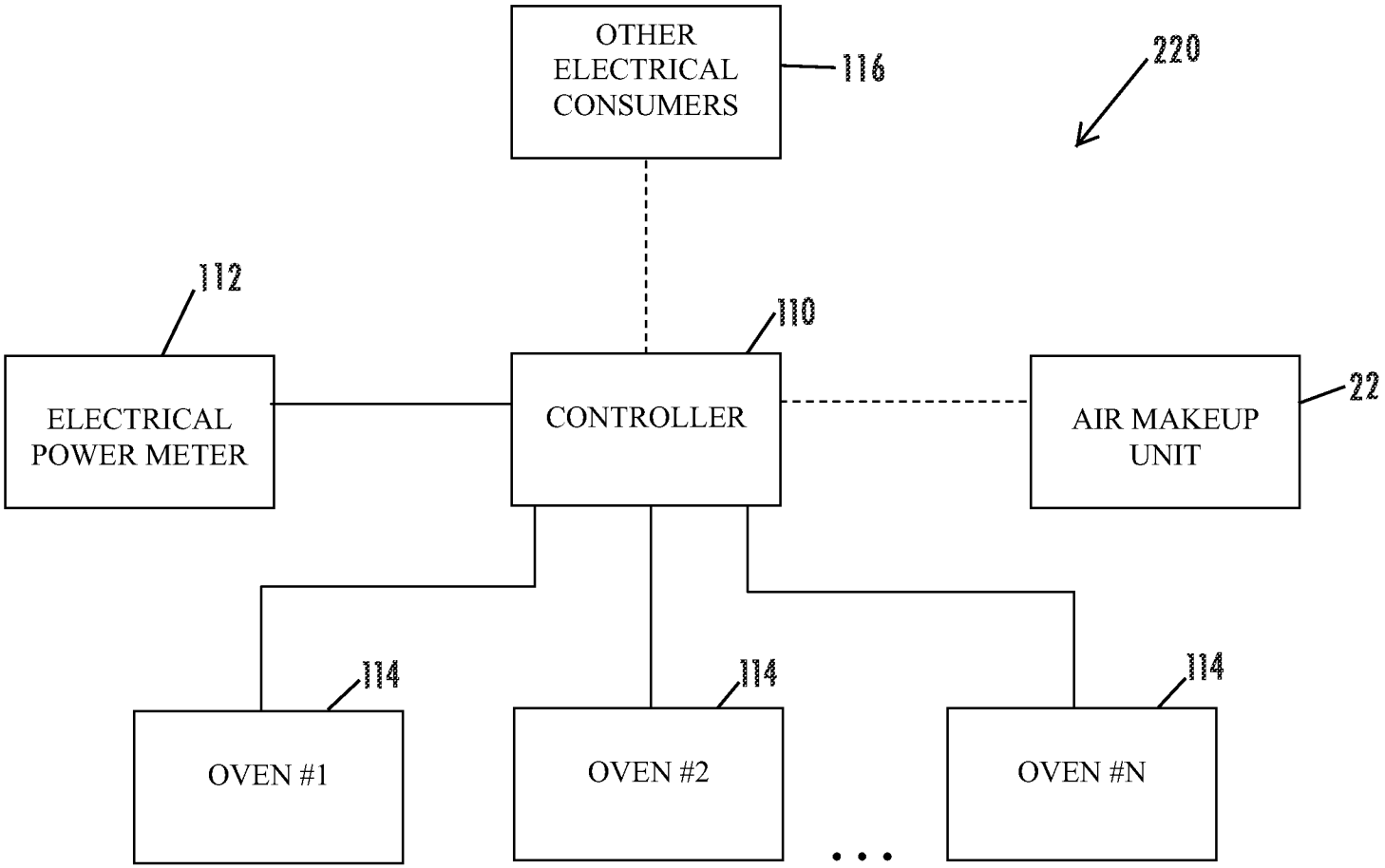
FIG. 4 is block diagram of another embodiment of an energy management system.

FIG. 4 illustrates in block diagram form another energy management system 220 that may be utilized by itself, or it may be combined with any of the various embodiments of energy management systems 20 and 120. In general, energy management system 220 is adapted to control the source of energy used in a heating operation, such as a drying oven or the like, in an economical manner. More specifically, energy management system 220 is suited for controlling the usage of electricity such that a company's or facility's electrical utility bills are reduced. System 220 accomplishes this by monitoring the electrical usage of a facility and switching to alternative sources of energy if the current conditions warrant a switch. Conditions that may warrant a switch to a secondary source of power may depend upon the current amount of electrical power being used, excessive utility charges, the cost of the secondary energy source, and/or other factors. In at least one embodiment, as will be discussed more below, energy management system 220 is configured to switch from using electricity to natural gas when the total amount of electricity used by the consumer exceeds a threshold, and to switch back to using electricity when the total amount used falls under the threshold. The threshold may vary at different times of the day.

As shown in FIG. 4, energy management system may include a controller 110, an electrical power meter 112, and one or more ovens 114. One or more air makeup units 22 may also be in communication with controller 110, although the integration of air makeup units 22 into system 220 is purely optional. Similarly, controller 110 may also be in communication with one or more other electricity consuming devices 116 as an optional variation of system 220. Controller 110 may take on a variety of different physical forms, such as, but not limited to, a personal computer with appropriate software, a server running one or more suitable applications, one or more microprocessors, Systems-on-a-Chip (SoC), combinatorial logic circuits, field programmable gate arrays, or other electronic components. More specifically, controller 110 may take on any electronic form suitable for carrying out the control algorithms discussed herein, such as would be known to one of ordinary skill in the art when read in conjunction with the description contained herein. Further, any programming of software or firmware necessary to carry out the algorithms disclosed herein would be able to be implemented by a person of ordinary skill in the art without any undue experimentation.

In at least one embodiment, energy management system 220 is particularly suited to addressing the issue of peak electrical usage. Most electrical utilities will charge their industrial electrical consumers an electrical rate that varies at different times during the day. For example, most electrical utilities will charge their industrial users less money per kilowatt-hour during the evening hours than during the daytime hours. This is often due to the fact that the electrical demands on the power company's generating capacities during the evening are greatly reduced. In addition to the different daytime/nighttime electrical rates, many electrical utilities will also set a peak amount of electrical usage that their industrial consumers may use during the day without incurring a financial penalty. For example, the electrical utility might specify that a particular industrial company's daytime electricity will be billed at a normal rate so long as the company's power usage during the day does not exceed a particular peak amount. If the company's electrical usage does exceed the particular peak amount, the charges for the electricity may jump to a higher rate. In some instances, the electric company may go from charging the customer a normal kilowatt-hour rate of, say, around 10-20 cents per kilowatt-hour, to an increased rate of more than a dollar per kilowatt-hour. A company's monthly electric bill can therefore increase dramatically if it exceeds the peak electrical usage for even relatively small amounts of time.

Energy management system 220 is adapted to help a company avoid such peak electrical rates and thereby avoid excessive electrical bills. Controller 110 is in communication with one or more ovens 114 as well as an electrical power meter 112. Such communication may be wired communication, wireless communication, or a combination thereof. The physical implementation of the communication may take on a variety of forms and may include one or more computer networks, such as Ethernet, or the like, as well as other forms of communication, such as, but not limited to, CAN networks, Bluetooth, the Internet, and others. Electrical power meter 112 may be a conventional power meter that monitors the total amount of electricity currently being used by an industrial consumer from a particular utility. This total amount of current electrical usage is forwarded to controller 110. Such forwarding takes place repetitively throughout the day. The frequency at which controller 110 forwards such updates to controller 110 may vary widely. In at least one embodiment, meter 112 may send updates multiple times a minute, or even multiple times a second. The format of the message indicating the amount of electricity currently being consumed can take on any suitable form.

Controller 110 is in communication with a memory (not shown) that may be either internal or external. Included within the memory is the peak threshold amount of electrical power that will trigger a higher rate from the electrical company. Thus, for example, if a utility charges the particular industrial consumer ten cents per kilowatt-hour during the day when the electrical consumption is less than 500 kilowatts, and then charges a higher rate for energy consumption greater than 500 kilowatts, the memory would store the 500 kilowatt figures as the peak threshold amount. This threshold peak may vary from customer to customer, and from utility to utility, and also may vary throughout the day, week, month, or other unit of time. That is, in at least some situations, the electric utility may have multiple tiers of electrical rates, depending upon usage, time of day, and/or calendar day. In such situations, the memory in communication with controller 110 will store whatever information is necessary in order for controller 110 to determine when a rate hike will occur, and whether the current electrical usage is causing, or is going to cause, a rate hike, and/or how much of a decrease in electrical consumption would trigger a rate decrease. In making these determinations, controller 110 may either include an internal clock, or be in communication with an external clock. Further, to the extent relevant to a particular electrical utility's electric rates, controller 110 may also include software that enables it to determine what calendar day it is and/or what day of the week it is.

Controller 110 is programmed or configured to compare the current amount of electrical usage to the peak threshold, or, if more than one, the multiple thresholds. From this comparison, controller 110 is able to determine whether the company (the industrial user) is currently paying a higher rate for its electricity or not. Controller 110 is further programmed to automatically make one or more changes to the amount of electricity consumed by the industrial user in response to the electrical usage approaching or exceeding one or more of the peak thresholds. One such change is to switch from using electrical power to an alternative source of energy, such as natural gas. In the embodiment shown in FIG. 4, controller 110 is in communication with one or more ovens 114 that can alternatively be heated by an electric heater or a gas heater, such as, but not limited to, a natural gas heater. If controller 110 determines that the current amount of electricity being consumed is above the threshold, or within a small range of the threshold (in which case there is the possibility of small changes in electrical usage causing the peak threshold to be exceeded), controller 110 may issue a command to one or more of the ovens 114 instructing them to switch from using an electric heater to using a gas heater. Such commands will reduce the amount of electrical usage by the industrial user. Such commands would typically only be issued if the energy cost of the gas was less than the energy costs of the electricity when taking into account the possibility—or actuality—of the power company's rate hike. Controller 110 thus serves to prevent a particular electrical consumer from exceeding the electrical usage rate or rates that trigger higher electrical utility costs.

Controller 110 may further be programmed to switch one or more dual-powered devices back to electricity usage when either: (1) the current amount of electrical usage by the industrial user has decreased a sufficient amount below the threshold, or (2) the time of the day has changed such that the threshold either no longer applies, or is increased to a higher level. In this manner, controller 110 helps a company avoid the large fees that accompany electrical usage above one or more thresholds.

Figure 5:
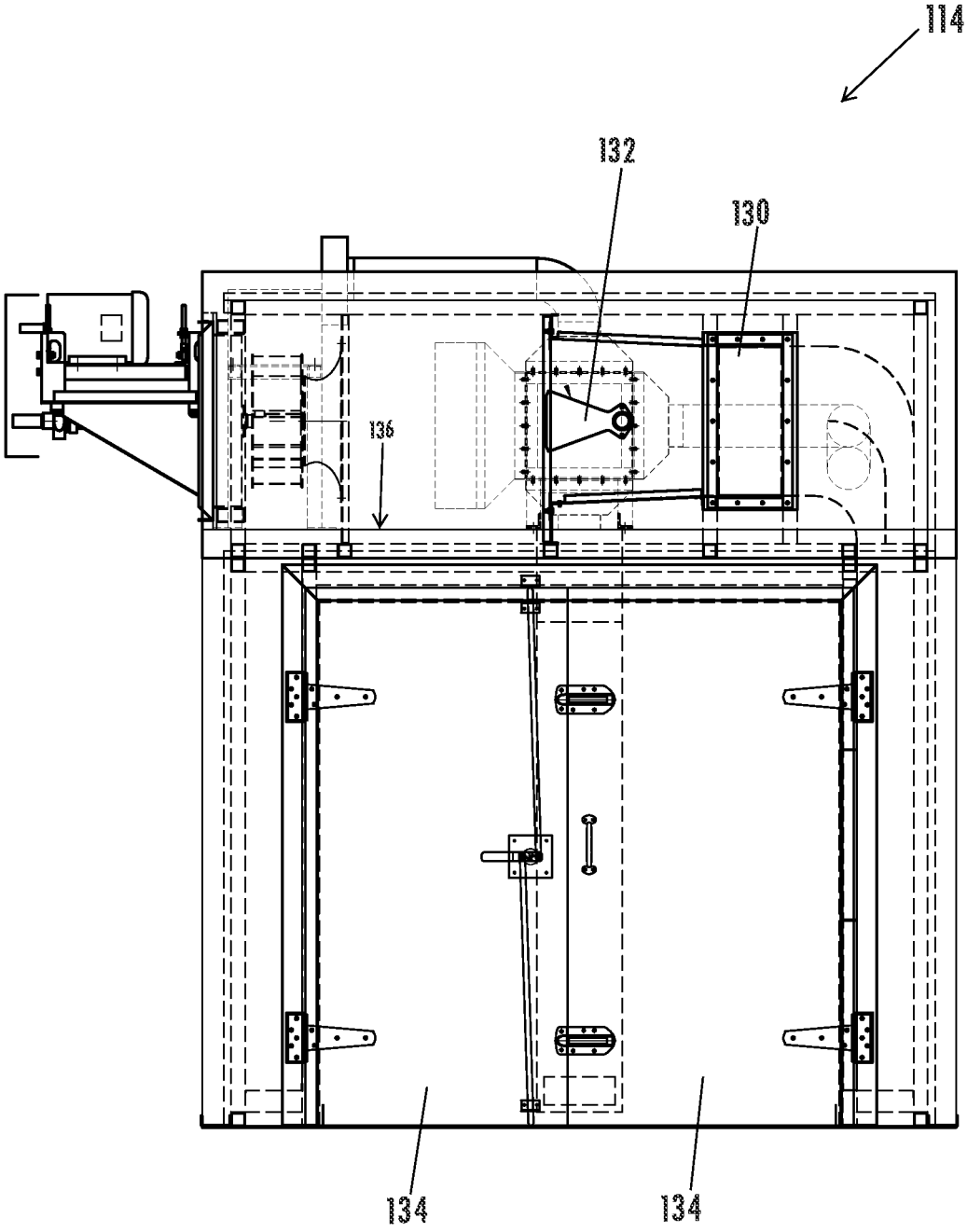
FIG. 5 is a front, elevational view of a drying oven that may be incorporated into various embodiments of the energy management systems disclosed herein.
Figure 6:
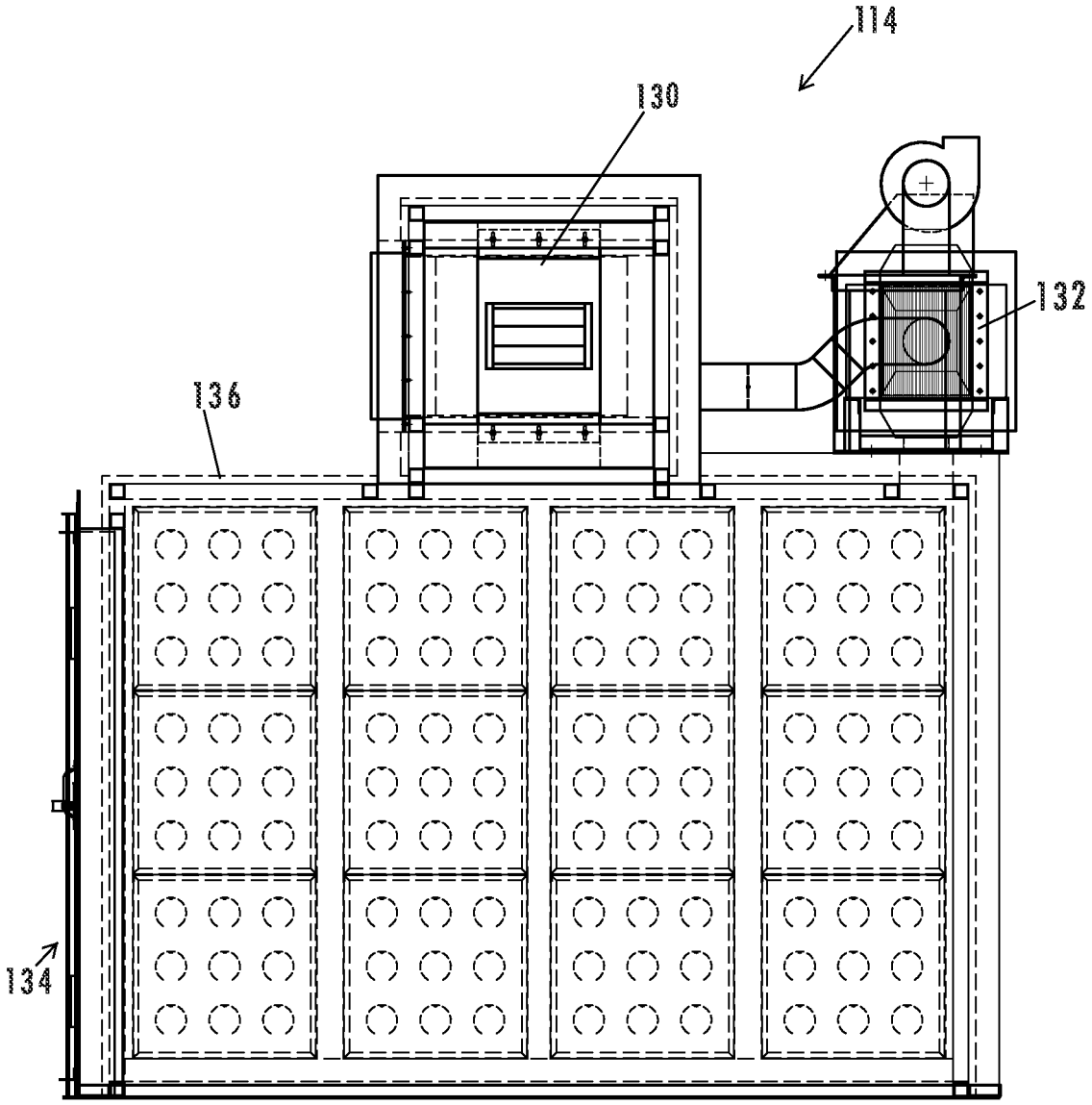
FIG. 6 is a side, elevational view of the oven of FIG. 5.
Figure 7:
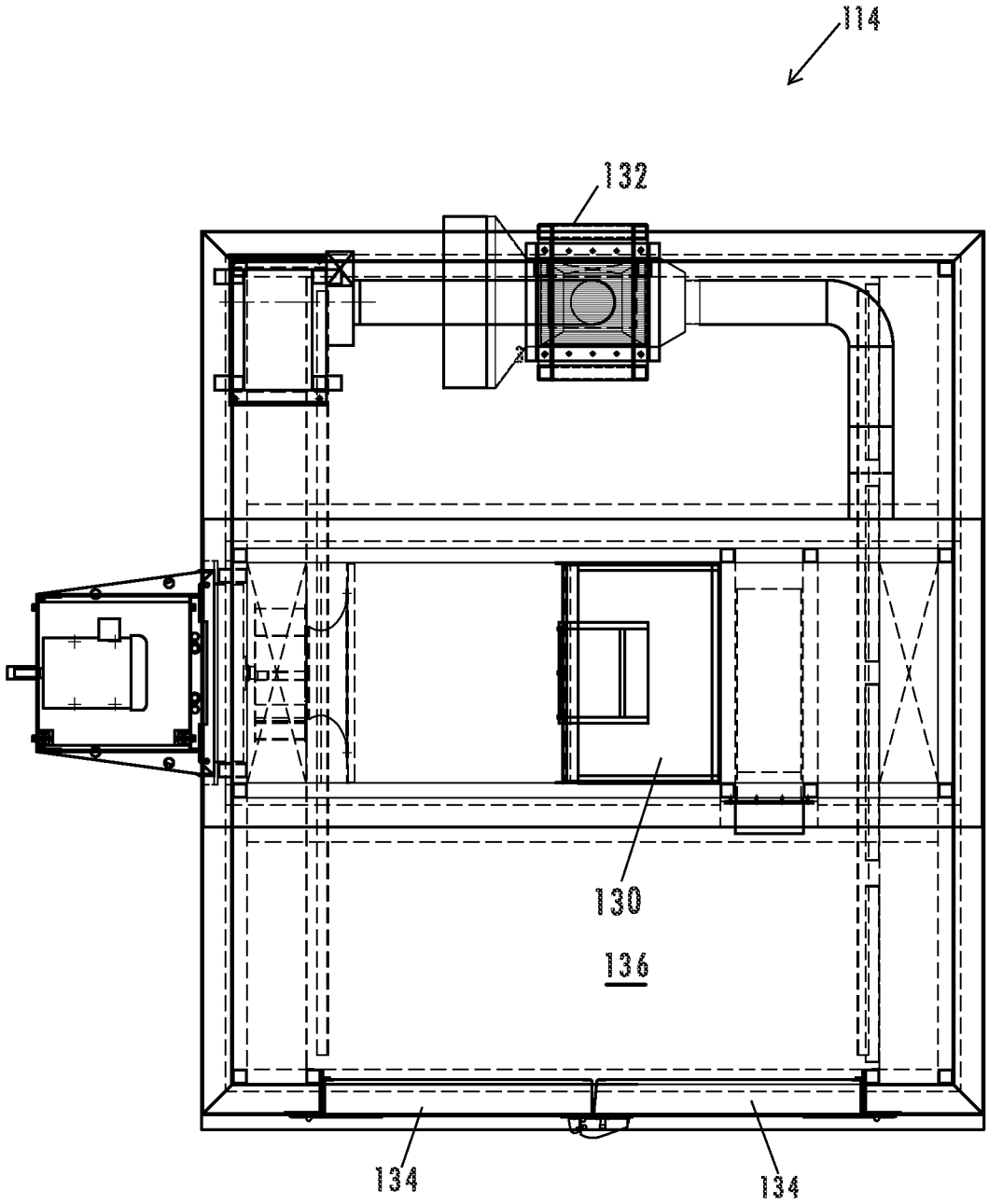
FIG. 7 is a plan view of the oven of FIG. 5.

FIGS. 5-7 illustrate one example of a type of oven 114 that may be controlled by controller 110. Oven 114 includes an electric heater 130 and a gas burner 132. Oven 114 further includes a pair of front doors 134 that may be opened and closed to allow access to an interior compartment in which items may be placed for heating. Gas burners 132 and electric heaters 130 are shown to be positioned on a roof 136 of oven 114. Roof 136 may be part of the roof of an actual building, such that heater 130 and burner 132 are exposed to the atmosphere, or roof 136 may be merely the roof of the oven and the entire oven 114 may be positioned inside a larger building that shields oven 114 from direct atmospheric exposure. The purpose of the heating provided by heater 130 and burner 132 may vary from embodiment to embodiment of system 220. In at least one embodiment, ovens 114 may use heat to dry products that have been painted. The painting of such products may occur within the same building as the ovens 114, such as in one or more of the spray booths 24 discussed previously, or the painting of the products may occur in a different facility.

Electric heater 130 and gas burner 132 may both be conventional devices that supply heat to the interior of oven 114. Controller 110 controls the operation of these two devices by turning one on and turning the other off. The thermal capacity of both gas burner 132 and electric heater 130 may vary widely. In one embodiment, gas burner 132 may be a 400 million British Thermal Unit (BTU) heater and electric heater 130 may be a 75 kilowatt electric heater.

Controller 110 may be further configured to switch on/off individual electric heaters 130 for individual ovens 114 based upon the current electrical usage of the electrical consumer, as determined by meter 112. That is, if the electricity usage of the consumer approaches the threshold, controller 110 may first switch a first oven 114 from electric heat to gas heat. If, because of other electricity usage by the consumer, the rate of electricity usage thereafter approaches or equals the threshold, controller 110 may then switch a second oven 114 from electric heat to gas heat. Still further, if additional ovens are present, controller 110 may continue to switch them from electric to gas heat as the electricity usage of the consumer increases. In an opposite manner, as the electricity usage of the consumer decreases, controller 110 may be programmed to individually switch ovens one at a time back to electricity from gas.

In addition to switching the ovens 114 from electric heat to gas heat, controller 110 may also automatically take other steps when the electricity usage approaches or reaches a threshold. For example, if controller 110 is in communication with one or more air makeup units 22, controller 110 may send a signal or message to the units 22 telling them to adjust their target temperature by a specified number of degrees. The target temperature adjustment would be in the direction that would cause less energy usage to occur. Thus, on days when the outside air was colder than the target temperature, the adjustment would be to lower the target temperature a specified number of degrees to reduce heating energy usage. On days when the outside air was warmer than the target temperature, the adjustment would be to raise the target temperature a specified number of degrees to reduce cooling energy usage. The maximum number of degrees by which the target temperature was adjusted could be set by the consumer so that temperature variations never exceeded an acceptable range. Controller 110 could likewise send messages to air makeup units 22 adjusting the target humidities in energy-conserving manners.

As yet another alternative, the speed at which certain electricity-consuming operations took place within the facility would also be slowed down in order to reduce electricity usage. Thus, as one possible example, if items are moving through spray booths 24 for painting at a particular line speed, the line speed could be slowed down by controller 110 in order to reduce electricity usage. Naturally, controller 110 would also include the ability to return the line speed to its normal or desired speed when conditions warranted. The maximum acceptable degree of speed reduction could also be set by the consumer. Controller 110 might also reduce electricity consumption by staggering certain manufacturing processes that normally take place simultaneously within the facility, such as, but not limited to, molding operations, or the like.

Controller 110 could also send control signals to any other type of electricity consuming devices 116 in which the amount of electricity consumed by the device could be reduced without causing unacceptable conditions in the manufacturing process or other processes taking place within a given facility of collection of facilities. The order in which controller 110 determines what devices should reduce their electricity usage could be programmed by the consumer so that the most operation-friendly reductions in electricity usage occurred first followed by those that were less operation-friendly.

It will be understood by those skilled in the art that meter 112 is a meter that monitors the total amount of electricity usage by a particular consumer from a particular electrical utility. Thus, the readings from meter 112, in combination with the time of day or other chronological information, will provide an indication of whether or not a particular customer (typically the company running the operation in the building or facility) is incurring peak electrical charges or not. In many cases, controller 110 may not be able to change the amount of electrical consumption of all, or even most, of the electrical devices whose power is being monitored by meter 112. Thus, stated alternatively, controller 110 may only control a subset of the devices whose electrical consumption is being monitored by meter 112.

It will also be understood by those skilled in the art that the threshold amount or amounts of electrical energy usage which controller 110 monitors may either be the actual threshold at which the electric utility's rate hike occurs, or they may be thresholds that are offset from the electric utility's rate transition number. For example, if an electric utility increases a particular consumer's rates when daytime energy usage increases above 1000 kilowatts, controller 110 might compare the current output from meter 112 directly to the 1000 kilowatts figure, or it might compare it to an offset number, such as, for example, 950 kilowatts. The purpose of using an offset number, such as 950 kilowatts, would allow controller 110 time to make necessary energy-usage adjustments before the peak electrical usage occurred, thereby preventing, to the extent possible, any incursions whatsoever above the peak threshold. It will therefore be understood that the reference to the term "threshold" refers to a number that may be different from the transition number set by the power company. The degree of difference (i.e. the offset), if any, can vary.

Changes and modifications in the specifically described embodiments can be carried out without departing from the principles of the invention which are intended to be limited only by the scope of the appended claims, as interpreted according to the principles of patent law including the doctrine of equivalents.

What is claimed is:

1. An energy management system for a building, said energy management system comprising:

an air intake unit adapted to draw air from outside the building into an interior of the building, said air intake unit adapted to condition the air to a target temperature;

a paint spray booth in which paint is applied to at least one product, said paint being applied in the presence of the conditioned air;

a water wash unit having a water basin configured to hold water, said water wash unit adapted to remove paint particulate from the conditioned air; and a pipe subsystem extending between the water basin and the air intake unit and including a pump, said pump adapted to circulate a liquid through the pipe subsystem between the water basin and the air intake unit wherein the circulated- liquid transfers heat between the water of the water basin and the air intake unit in such a manner so as to assist the air intake unit in conditioning the air drawn from outside the building, wherein the pipe subsystem further includes a first heat exchanger positioned within the water basin and a second heat exchanger positioned inside said air intake unit, said first heat exchanger adapted to transfer heat between the water of said water basin and the liquid inside said pipe subsystem and said second heat exchanger adapted to transfer heat between the liquid inside said pipe subsystem and the air drawn from outside the building into the air intake unit.

2. The system of claim 1 wherein the liquid inside of said pipe subsystem includes water.

3. The system of claim 1 wherein said first heat exchanger is submerged within water contained in the water basin.

4. The system of claim 1 further including;

a temperature sensor positioned within said air inlet unit and adapted to measure a temperature of air flowing into said air inlet unit;

a controller in communication with said temperature sensor and said pump, said controller adapted to control a flow rate of said pump based at least partially upon the temperature sensed by said temperature sensor.

5. The system of claim 1 wherein said air intake unit is further adapted to condition the air drawn from outside the building to a target humidity.

6. The system of claim 1 further including:

a second paint spray booth in which paint is applied to at least one product, said paint being applied in the presence of the conditioned air;

a second water wash unit having a second water basin, said second water wash unit adapted to remove paint particulate from the conditioned air; and a heat exchanger in thermal communication with said second water basin and said liquid within said pipe subsystem, said heat exchanger adapted to transfer heat between said liquid and said second water basin.

7. The system of claim 1 wherein said first heat exchanger comprises a plurality of plates that are positioned within said water basin.

8. The system of claim 1 wherein said second heat exchanger comprises an energy recovery coil positioned inside said air intake unit.

* * * * *